US007726019B2

(12) United States Patent
Eroglu et al.

(10) Patent No.: US 7,726,019 B2
(45) Date of Patent: Jun. 1, 2010

(54) METHOD FOR REDUCING EMISSIONS FROM A COMBUSTOR

(75) Inventors: Adnan Eroglu, Untersiggenthal (CH); Oliver Riccius, Birmenstorf (CH); Klaus Knapp, Gebenstorf (CH); Peter Flohr, Turgi (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 12/436,900

(22) Filed: May 7, 2009

(65) Prior Publication Data

US 2009/0282831 A1 Nov. 19, 2009

(30) Foreign Application Priority Data

May 15, 2008 (EP) ..... 08156299

(51) Int. Cl.
*B23P 6/00* (2006.01)
*F02C 1/00* (2006.01)

(52) U.S. Cl. ..... 29/888.011; 29/888.01; 29/889.22; 60/772; 60/747; 60/725

(58) Field of Classification Search ..... 29/888.01, 29/888.011, 889.2, 889.22; 60/772, 747, 60/725
See application file for complete search history.

(56) References Cited

U.S. PATENT DOCUMENTS

| | | | | |
|---|---|---|---|---|
| 4,720,970 | A | 1/1988 | Hudson et al. | |
| 5,297,385 | A | 3/1994 | Dubell et al. | |
| 5,901,549 | A | 5/1999 | Mandai et al. | |
| 6,430,930 | B1 | 8/2002 | Andersson | |
| 2004/0182085 | A1 | 9/2004 | Jeppel et al. | |
| 2009/0282830 | A1 * | 11/2009 | Eroglu et al. | 60/725 |

FOREIGN PATENT DOCUMENTS

| | | |
|---|---|---|
| DE | 4040745 | 7/1991 |
| DE | 4202588 | 7/1993 |
| DE | 4336096 | 5/1994 |
| DE | 4339094 | 5/1995 |
| EP | 1724526 | 11/2006 |
| GB | 2275738 | 9/1994 |
| WO | WO93/10401 | 5/1993 |
| WO | WO9812478 | 3/1998 |

OTHER PUBLICATIONS

Search Report for European Patent App. No. 08156297.7 (Nov. 8, 2007).
Search Report for European Patent App. No. 08156299.3 (Nov. 13, 2008).

* cited by examiner

*Primary Examiner*—David P Bryant
*Assistant Examiner*—Sarang Afzali
(74) *Attorney, Agent, or Firm*—Cermak Kenealy Vaidya & Nakajima LLP; Adam J. Cermak

(57) ABSTRACT

A modification method for reducing emissions from an annular shaped combustor of a gas turbine plant, having uniformly spaced circumferentially mounted premix burners (20), includes the steps of: removing at least one burner (20), thereby disrupting the spatial uniformity of the remaining the burners (20); and modifying the combustor air distribution system so as to compensate for the increased burner pressure drop of the remaining burners, thus enabling the modified combustor to operate at a load equivalent to the unmodified combustor. Emission reduction is enabled by the increase in the gas velocity of the burner for a given load further enabled by the flame stabilizing effect of disrupting the spatial uniformity.

5 Claims, 2 Drawing Sheets

METHOD FOR REDUCING EMISSIONS FROM A COMBUSTOR

This application claims priority under 35 U.S.C. §119 to European patent application no. 08156299.3, filed 15 May 2008, the entirety of which is incorporated by reference herein.

BACKGROUND

1. Field of Endeavor

The invention relates to the reduction of emissions from an annular combustor of a gas turbine plant. More specifically, the invention relates to a method of reducing emissions from premix burners used in the high-pressure combustor of a gas turbine plant with sequential combustors.

2. Definitions

In particular, throughout this specification a gas turbine plant is taken to mean and is defined as a gas turbine plant shown in FIG. 1 and described as follows. The first element of the gas turbine plant is a compressor 21 for compressing air for use in a high-pressure combustion chamber 22 fitted with premix burners 20 and also for cooling. Partially combusted air from the high-pressure combustor 22 passes through a high-pressure turbine 23 before flowing further into a low-pressure combustion chamber 24 where combustion occurs by self-ignition. In this chamber fuel is added to unburnt air from the first combustor 12 via a lance 37. The hot combustion gases then pass through a lower pressure turbine 25 before passing through a heat recovery steam generator. In order to generate electricity, the compressor 21 and turbines 23, 25 drive a generator 26 via a shaft 30

Further, throughout this specification a pre-mix burner is taken to mean and is defined as a burner, as shown in FIG. 2, suitable for use in the high-pressure combustor of a gas turbine plant. More specifically, it includes a conical swirl shaped body in the form of a double cone 11, which is concentric with a burner axis surrounded by a swirl space 17. A central fuel lance 12 lies within the burner axis extending into the swirl space 17 to form the tip of the swirl body 11. In a first stage 18, pre-mix fuel is injected radially into the swirl space 17 through injection holes in the fuel lance 12. In a second stage 14, pre-mix fuel is injected through injection holes located in the double cone 11 section of the burner into an air stream conducted within the double cone 11.

3. Brief Description of the Related Art

Combustion chamber dynamics of gas turbine plants with annular ring combustors not having canned burners are generally dominated by circumferential pressure pulsation. There are many supplementary causes for the pulsation, including the velocity of the fuel/air mixture through the burner, where the higher the velocity the greater the pulsation potential. In contrast to the negative effect of increased burner gas velocity, increasing velocity reduces NOx and for this reason alone there is a need to have alternative methods that enable higher burner gas velocity operation. Further as older plants are general poorer performing than newer plants, the desire to improve the emission performance of older plants is particularly high.

A method of ameliorating the detrimental effects preventing higher burner velocity operation is by disruption of burner configurational spatial uniformity. For example, DE 43 36 096 describes an arrangement where burners are displaced longitudinally in relation to each other, while WO 98/12479 discloses a burner arrangement where burners of different sizes are used as a means of stabilizing the flame.

While for new designs such configurations can easily be configured, the opportunity to change the burner layout in a preconfigured combustor is limited and, as a result, the above layouts cannot be suitably applied to preconfigured combustors. U.S. Pat. No. 6,430,930, disclosing an arrangement having burners with varying characteristic shapes along the longitudinal direction, as well as a secondary feature in the radial plane, is similarly unsuitable as suitably significant disruption of the spatial uniformity of burners cannot be achieved such that significant burner velocity change can be realized without redesigning of the combustor chamber.

Despite the unsuitability of known methods, there remains a need to reduce the emissions of existing gas turbine plants by solutions that do not require major modification involving changing the size of the combustor.

SUMMARY

One of numerous aspects the present invention includes a solution to the problem of emissions from a pre configured gas turbine plant.

Another aspect relates to the general idea of removing at least one burner to radically disrupt the circumferential distribution of pre mix burners entailing more than just rearrangement of burners in an existing configuration. Correspondingly, an aspect of the invention includes a modification method for reducing emissions from an annular shaped combustor of a gas turbine plant having uniformly spaced, circumferentially mounted premix burners, including the steps of:

a) removing at least one of the burners thereby disrupting the spatial uniformity of the remaining burners, and b) modifying the combustor air distribution system so as to compensate for the increased burner pressure drop of the remaining burners and enable the modified combustor to operate at a load equivalent to the unmodified combustor.

In this way combustor emissions for a given combustor load are reduced by increasing burner velocity enabled by step b) and the flame stabilizing effect of disrupting the burner spatial uniformity, and thus a cost effective way of improving the performance of an existing combustor can be realized.

Fitting of pulsation dampening devices, such as Helmholtz resonators, that conventionally cannot be retrofitted into existing combustion chambers is also enabled by burner removal. As a result, in a further aspect a removed burner is replaced with a pulsation-dampening device.

In another aspect, the combustor is a split combustor with two split lines, where burners removed in step a) are adjacent to the split lines. The split line is an area prone to air leakage resulting in localized combustor temperature suppression. By removing burners in this area, carbon monoxide burnout is improved.

In another aspect, the four burners adjacent to the split lines are removed. In another aspect, the method is applied to an unmodified combustor having 20 burners.

A further aspect of the invention includes overcoming, or at least ameliorating, the disadvantages and shortcomings of the prior art or provide a useful alternative.

Other aspects and advantages of the present invention will become apparent from the following description, taken in connection with the accompanying drawings wherein by way of illustration and example, an embodiment of the invention is disclosed.

BRIEF DESCRIPTION OF THE DRAWINGS

By way of example, an embodiment of the invention is described more fully hereinafter with reference to the accompanying drawings, in which.

DETAILED DESCRIPTION OF EXEMPLARY EMBODIMENTS

Figure 1:
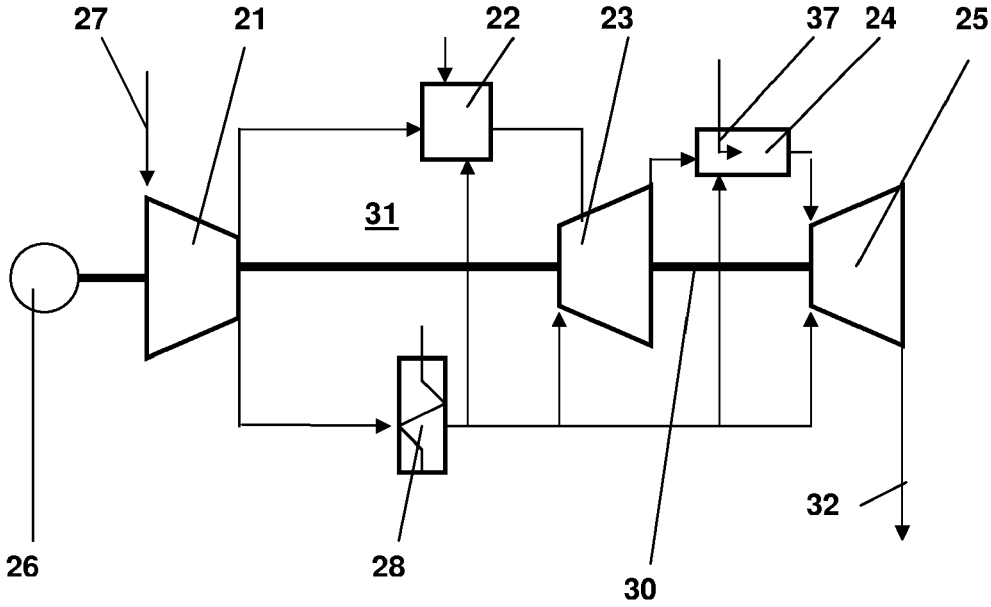
FIG. 1 (Prior Art)
FIG. 1 is a schematic view of a gas turbine plant.
Figure 2:
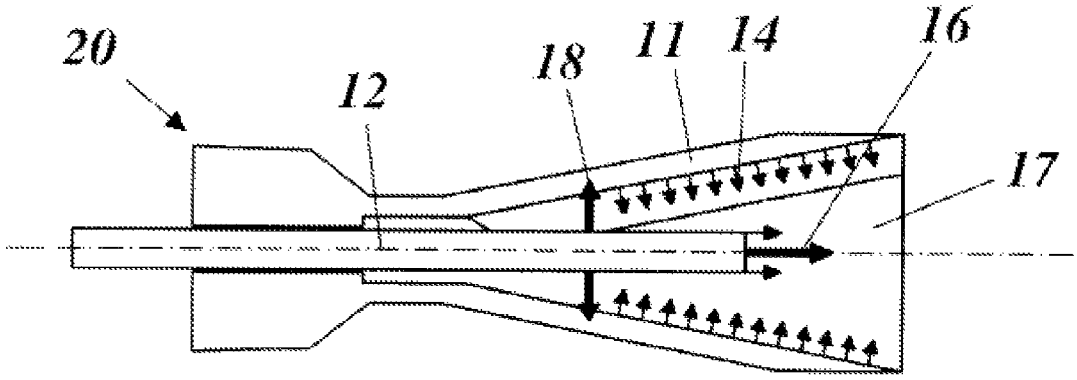
FIG. 2 (Prior Art)
FIG. 2 is a sectional cut away view of a staged premix burner.

Preferred embodiments of the present invention are now described with reference to the drawings, wherein like reference numerals are used to refer to like elements throughout. In the following description, for purposes of explanation, numerous specific details are set forth in order to provide a thorough understanding of the invention. It may be evident, however, that the invention may be practiced without these specific details.

Figure 3:
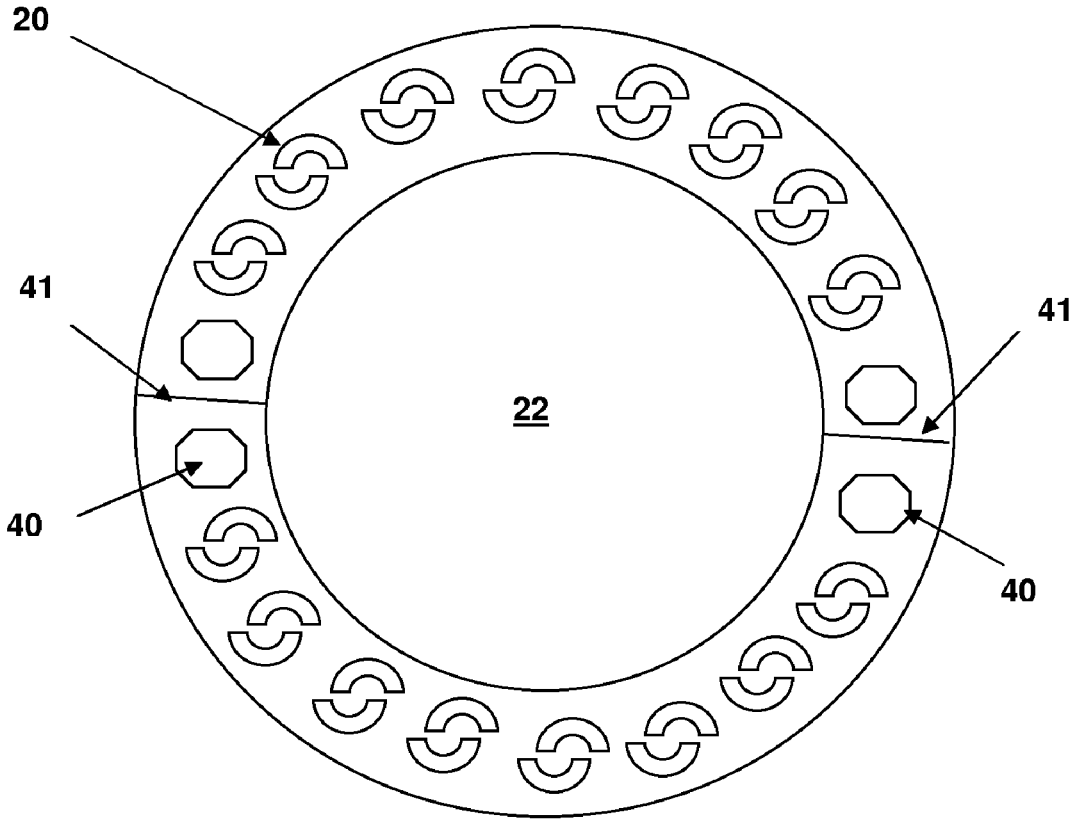
FIG. 3 is a preferred exemplary arrangement in accordance with the invention showing a cross sectional end view of circumferentially mounted premix burners of FIG. 2 in a high-pressure combustor of a gas turbine plant of FIG. 1

In an embodiment of the invention, as shown in FIG. 3, at least one, but preferably four, premix burners 20 of the high pressure combustor 22 of a gas turbine plant 31, preferably located adjacent to the split line 41 of the combustor chamber 22, are removed and plugged 40. For a typical combustor arrangement having twenty burners, the gas velocities through the burner may be up to 32 m/s. With the removal of four burners 20 this increases to 40 m/s. Correspondingly, the pressure drop increases also by 44%.

To compensate for the increased burner pressure drop, the air distribution system to the burner must be modified. In a typical arrangement air is supplied to burners from a plenum surrounding the combustor via two pathways: a cooling pathway, where air is used to provide impingement and convective cooling of the liner of the combustor; and via a bypass pathway where air is supplied directly to the burners via apertures in segmenting portions between burners and plenum. The relative amount of bypass and cooling air supplied to the burner is defined by the pressure difference between the burner and the plenum. In a preferred embodiment, to compensate for the higher burner pressure that reduces the pressure driving force between burners and the plenum and potentially results in a lower air rate, the aperture size through the segmenting portion is increased thereby increasing the bypass air rate. In this way reduced cooling air rate is compensated for by an increased bypass air rate so as to maintain the required air rate. While this is a method of compensating for the increased burner pressure drop other modifications dependant on combustor design could also be made, provided that adequate rate of air is supplied to burners and cooling of the combustor is not detrimentally compromised.

The space left by the removed burners is, in one embodiment, plugged, while in another embodiment is used to fit thermo-acoustic vibration suppression or dampening devices such as Helmholtz resonators.

Although the invention has been herein shown and described in what is conceived to be the most practical and preferred embodiment, it is recognized that departures can be made within the scope of the invention, which is not to be limited to details described herein but is to be accorded the full scope of the appended claims so as to embrace any and all equivalent devices and apparatus.

REFERENCE NUMBERS

11. Double cone
12. Fuel lance
18. First stage
14. Second stage
16. Liquid fuel
17. Swirl space
20. Premix burner
21. Compressor
22. High-pressure combustor
23. High-pressure turbine
24. Low pressure combustor
25. Low-pressure turbine
26. Generator
27. Air
28. Air cooler
30. Shaft
31. Gas turbine plant
32. Exhaust gases
37. Low pressure combustor lance
40. Removed burner blank
41 Combustor split line While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A modification method for reducing emissions from an annular shaped combustor of a gas turbine plant having uniformly spaced, circumferentially mounted premix burners and a combustor air distribution system, the method comprising:

removing at least one of said burners thereby disrupting the spatial uniformity of the remaining said burners and creating a modified combustor; and modifying said combustor air distribution system to compensate for an increase burner pressure drop of said remaining burners, thereby enabling said modified combustor to operate at a load equivalent to the unmodified combustor;

wherein said removing and said modifying together;

reducing combustor emissions for a given combustor load by increasing burner velocity from said modifying; and flame stabilizing by disrupting said spatial uniformity by said removing.

2. The method of claim 1, wherein said combustor comprises a split combustor with two split lines, and wherein said removing comprises removing said at least one burner from adjacent to said split lines.

3. The method of claim 2, wherein said removing at least one burner comprises removing four burners.

4. The method of claim 1, wherein, before said removing, said combustor comprises twenty burners.

5. The method of claim 1, further comprising:

replacing said at least one removed burner with a pulsation damping device.

* * * * *